US007976649B2

(12) United States Patent
Klose et al.

(10) Patent No.: US 7,976,649 B2
(45) Date of Patent: Jul. 12, 2011

(54) METHOD OF FABRICATING STRIPS OR FOILS, RESPECTIVELY, FROM TIAL6V4

(75) Inventors: Joachim Klose, Oederan (DE); Ella Rehtanz, Freiberg (DE); Christiane Rothe, Groβschirma/OT Obergruna (DE); Ines Eulitz, Freiberg (DE); Werner Beck, Weyhe (DE)

(73) Assignee: GfE Fremat GmbH, Freiberg (DE)

( * ) Notice: Subject to any disclaimer, the term of this patent is extended or adjusted under 35 U.S.C. 154(b) by 332 days.

(21) Appl. No.: 12/194,624

(22) Filed: Aug. 20, 2008

(65) Prior Publication Data

US 2009/0050242 A1 Feb. 26, 2009

(30) Foreign Application Priority Data

Aug. 24, 2007 (DE) ..... 10 2007 040 132

(51) Int. Cl.
*C22F 1/18* (2006.01)

(52) U.S. Cl. ..... 148/564; 148/670

(58) Field of Classification Search ..... None
See application file for complete search history.

(56) References Cited

U.S. PATENT DOCUMENTS

| | | | | |
|---|---|---|---|---|
| 3,169,085 A | | 2/1965 | Newman | |
| 4,675,055 A | | 6/1987 | Ouchi et al. | |
| 4,805,294 A | | 2/1989 | Siemers | |
| 4,838,337 A | | 6/1989 | Siemers | |
| 5,222,282 A | | 6/1993 | Sukonnik et al. | |
| RE38,316 E | * | 11/2003 | Oyama et al. | 148/669 |
| 2007/0131314 A1 | * | 6/2007 | Kuroda | 148/421 |

FOREIGN PATENT DOCUMENTS

| | | |
|---|---|---|
| DE | 195 32 278 | 3/1997 |
| DE | 102005052918 | 5/2007 |
| GB | 852 405 | 10/1960 |

OTHER PUBLICATIONS

Machine Translation of DE 10 2005 059218 A1, published May 16, 2007.*

* cited by examiner

*Primary Examiner* — George Wyszomierski
(74) *Attorney, Agent, or Firm* — McGlew and Tuttle, P.C.

(57) ABSTRACT

A method of fabricating a superplastically formable strip or a superplastically formable foil from TiAl6V4 with a thickness of no more than 0.9 mm, preferably less than or equal to 0.5 mm, comprises the steps:

a) hot rolling a sheet metal made of TiAl6V4;

b) thermal pre-treatment of the hot-rolled sheet metal at a temperature between 650 and 850° C.; and c) cold rolling the hot-rolled and thermally pre-treated sheet metal at a forming rate of at least 30%, wherein the forming rate per single pass amounts to between 1 and 15%, to form a strip or a foil with a thickness of no more than 0.9 mm, wherein the cold-rolled strip or the cold-rolled foil is not annealed.

18 Claims, No Drawings

METHOD OF FABRICATING STRIPS OR FOILS, RESPECTIVELY, FROM TIAL6V4

BACKGROUND OF THE INVENTION

1. Field of the Invention

The present invention concerns a method of fabricating a superplastically formable strip or a superplastically formable foil from TiAl6V4 with a thickness of no more than 0.9 mm.

2. Background Art

Owing to their good application properties such as very low density, high stability and excellent corrosion resistance, titanium alloys such as TiAl6V4 are used in many industrial branches, for instance aerospace industry, chemical industry, medical engineering and mechanical engineering. According to application, different demands are placed on the titanium alloys as to the specific properties thereof. The workability of materials made of TiAl6V4 is limited, however, since TiAl6V4, which consists of a mixture of the α- and the β-phase, shows exceptionally poor cold forming properties.

Materials made of TiAl6V4 are often brought into the desired final shape by superplastic formation. Depending on the desired final thickness of the material, this requires basic materials of a higher or lower thickness. TiAl6V4 strips or TiAl6V4 foils, respectively, with a thickness less than 1 mm are not commercially available, however. Moreover, the prior-art methods of fabricating such TiAl6V4 strips or TiAl6V4 foils, respectively, are very complex and have more or less considerable drawbacks.

U.S. Pat. No. 4,838,337 discloses a method of fabricating foils from a titanium alloy in which a powder with the desired composition is at first applied to a metal foil by plasma spraying, causing a titanium alloy deposit to form which is then separated from the metal foil by dissolving the metal foil in a solution of nitric acid.

U.S. Pat. No. 4,805,294 discloses a method of fabricating thin foils from a titanium alloy in which a powder with the desired composition is at first applied to a metal foil by plasma spraying, causing a titanium alloy deposit to form which is then separated from the metal foil and rolled to reduce the thickness thereof and to improve the smoothness of the surface. This method is however very complex. Moreover, this method allows fabrication of only very small sizes with partly imperfect micro structures.

SUMMARY OF THE INVENTION

Thus it is the object of the present invention to provide a method of fabricating strips or foils from TiAl6V4 with a thickness of no more than 0.9 mm, said method being performable in a quick and easy manner while enabling strips or foils, respectively, to be fabricated which show good forming properties, a uniform thickness and smooth surface without pores.

This object is achieved according to the invention by a method of fabricating a superplastically formable strip or a superplastically formable foil from TiAl6V4 with a thickness of no more than 0.9 mm, the method comprising the following steps:

a) hot rolling a sheet metal made of TiAl6V4;
b) thermal pre-treatment of the hot-rolled sheet metal at a temperature between 650 and 850° C.; and
c) cold rolling the hot-rolled and thermally pre-treated sheet metal at a forming rate of at least 30%, wherein the forming rate per single pass amounts to between 1 and 15%, to form a strip or a foil with a thickness of no more than 0.9 mm, wherein the cold-rolled strip or the cold-rolled foil is not annealed.

This solution is based on the surprising fact that a method in which a sheet metal made of TiAl6V4 is at first hot-rolled before it is subject to thermal pre-treatment and then cold-rolled at a specific forming rate to obtain a thickness of no more than 0.9 mm results in a strip or a foil of TiAl6V4 which shows an excellent superplastic formability, a uniform thickness and a smooth surface without pores. This was unexpected in particular due to the known fact that materials made of TiAl6V4 show exceptionally poor cold forming properties. Furthermore, the strips or foils, respectively, which are fabricable from TiAl6V4 according to the invention, show a homogeneous microstructure. Moreover, it has been unexpectedly found that the α-phase concentration at the surface of the strips or foils, respectively, which are fabricable from TiAl6V4 according to the invention, is lower than in prior-art TiAl6V4 materials. Thus when examined by way of light-optical microscopy, the surface of the strips or foils, respectively, fabricated from TiAl6V4 according to the invention does not show a pure α-phase but only a thin zone (a so-called "α-case") with an α-phase concentration and a thickness of approximately 1 to 2 μm. Another advantage of the inventive method is that annealing of the strip or the foil, respectively, fabricated from TiAl6V4 is dispensed with, with the result that an additional absorption of oxygen by the material, which inevitably happens during annealing, and thus a formation of an α-case and a reduction or even a loss of ductility, is reliably prevented.

The inventive method is basically not restricted in terms of the specific hot-rolling process parameters. Hot-rolling within the scope of the present invention may comprise one or several hot-rolling steps. Good results are in particular achieved if the hot-rolling process according to process step a) is performed at a temperature between 800 and 1,050° C., and particularly preferably between 800 and 1,000° C. If two or more hot-rolling steps are performed, the last hot-rolling step may also be performed at a temperature below the lower limit of the aforementioned temperature ranges.

It has furthermore proved to be advantageous to perform the hot-rolling process at a forming rate of between 20 and 90%, and particularly preferably between 30 and 80%.

The inventive method may basically be carried out with a conventional TiAl6V4 alloy, wherein said alloy, as stipulated in DIN ISO 5832-3, may have a composition that comprises between 5.5 and 6.75 wt % of aluminum, between 3.5 and 4.5 wt % of vanadium, less than or equal to 0.3 wt % of iron, less than or equal to 0.2 wt % of oxygen, less than or equal to 0.08 wt % of carbon, less than or equal to 0.05 wt % of nitrogen, less than or equal to 0.015 wt % of hydrogen and titanium as remainder.

DESCRIPTION OF THE PREFERRED EMBODIMENTS

According to a preferred embodiment of the present invention, the TiAl6V4 alloy of the used sheet metal has the following composition after hot-rolling, in other words after performing step a):

5.5 to 6.5 wt % of aluminum;
3.5 to 4.3 wt % of vanadium;
less than 0.02 wt % of nitrogen;
less than 0.05 wt % of carbon;
less than 0.15 wt % of oxygen;
less than 0.01 wt % of hydrogen;
less than 0.2 wt % of iron and
remainder: unavoidable impurities and titanium.

It has been found within the scope of the invention that a hot-rolled sheet metal of the aforementioned composition allows a strip or foil, respectively, of TiAl6V4 to be obtained which shows excellent superplastic forming properties after the subsequent thermal pre-treatment and the final cold-rolling process.

As a development of the inventive idea, it is proposed for the TiAl6V4 alloy to have the following composition after hot-rolling according to step a):

5.5 to less than 6.0 wt % of aluminum;
3.5 to 4.2 wt % of vanadium;
less than 0.02 wt % of nitrogen;
less than 0.05 wt % of carbon;
less than 0.15 wt % of oxygen;
less than 0.01 wt % of hydrogen;
less than 0.15 wt % of iron and
remainder: unavoidable impurities and titanium.

Thermal pre-treatment according to step b) may be performed at any desired temperature between 650 and 850° C., wherein particularly good results are achieved if the temperature during thermal pre-treatment amounts to between 700 and 800° C.

Thermal pre-treatment is advantageously performed in a high vacuum to prevent any, or almost any, oxygen from being absorbed by the surface of TiAl6V4 so as to avoid a concentration of the α-phase at the surface. Thermal pre-treatment may for instance be performed for 0.5 to 2 hours at a temperature between 700 and 800° C. in a high vacuum, preferably for 1 hour at 760° C. in a high vacuum, wherein the sheet metal is cooled down preferably slowly after thermal pre-treatment, for instance for 10 to 24 hours, and preferably for 12 to 20 hours. High vacuum within the scope of this invention is a pressure which amounts to a maximum of 13.3 mPa or $10^{-4}$ Torr, respectively.

In addition to thermal pre-treatment, a mechanical pre-treatment of the hot-rolled sheet metal may be performed between the process steps a) and c), wherein the mechanical pre-treatment may be performed prior to, simultaneously with or after the thermal pre-treatment according to process step b).

For instance, the process step of mechanical pre-treatment may comprise or consist of grinding the surface of the hot-rolled sheet metal.

As an alternative to grinding the surface of the hot-rolled sheet metal or in addition thereto, said optional mechanical pre-treatment may comprise chemical cleaning, preferably degreasing with a degreasing agent.

The hot-rolled sheet metal used in step c) preferably has a thickness of at least 1 mm.

According to the invention, cold-rolling of the hot-rolled and thermally pre-treated sheet metal to form the strip or the foil with a thickness of no more than 0.9 mm is performed at a forming rate of at least 30%, wherein the forming rate per single pass amounts to between 1 and 15%. According to the invention, the forming rate is obtained by the following equation:

(initial thickness of the sheet metal prior to cold-rolling−final thickness of the strip after cold-rolling)/initial thickness of the sheet metal prior to cold-rolling).

Cold-rolling according to process step c) preferably takes place at a forming rate of between 30% and 80%, and particularly preferably at a forming rate of between 45 and 60%.

Moreover, it is preferred that the cold-rolling process according to step c) is performed at a forming rate of between 2 and 10% per single pass, and preferably at a forming rate of between 3 and 7% per single pass.

According to the invention, process step c) may consist of one cold-rolling step comprising several single passes or may comprise two or several cold-rolling steps with one intermediate annealing step in-between two rolling steps. While one cold-rolling step is usually sufficient for strips to be fabricated with a final thickness between 0.4 and 0.9 mm, two or several cold-rolling steps with one intermediate annealing step in-between two rolling steps proved to be advantageous for strips or foils, respectively, to be fabricated with a final thickness less than 0.4 mm.

According to the last-mentioned embodiment, the cold-rolling process according to process step c) preferably comprises the following steps:

$c_1$) cold-rolling the hot-rolled and thermally pre-treated sheet metal of step b) at a forming rate of at least 30%, wherein the forming rate per single pass amounts to between 1 and 15%, to form a strip or a foil with a thickness of no more than 0.9 mm;

$c_2$) intermediate annealing of the strip or foil, respectively, obtained in step $c_1$) at a temperature between 650 and 850° C.; and $c_3$) cold-rolling of the strip or the foil, respectively, obtained in step $c_2$) at a forming rate of between 10 and 40% until the final thickness is reached, wherein the forming rate per single pass amounts to between 0.1 and 10%.

In this embodiment, the forming rate in process step $c_1$) preferably also amounts to between 30% and 80%, and particularly preferably to between 45 and 60%, wherein the forming rate per single pass preferably amounts to between 2 and 10%, and particularly preferably to between 3 and 7%.

Intermediate annealing according to process step $c_2$) may be performed at any desired temperature between 650 and 850° C., wherein particularly good results are achieved if the temperature for intermediate annealing amounts to between 700 and 800° C.

Intermediate annealing preferably takes place in a high vacuum to prevent any, or almost any, oxygen from being absorbed by the surface of TiAl6V4 so as to avoid a concentration of the α-phase at the surface. For instance, intermediate annealing may be performed for 0.5 to 2 hours at a temperature between 700 and 800° C. in a high vacuum, preferably for 1 hours at 760° C. in a high vacuum, wherein the material is cooled down preferably slowly after the intermediate annealing process, for instance for 10 to 24 hours, and preferably for 12 to 20 hours.

As a development of the inventive idea, it is proposed to perform the cold-rolling process according to process step $c_3$) at a forming rate of between 15 and 30%, wherein the forming rate per single pass preferably amounts to between 0.5 and 5%.

Irrespective of whether one, two or more than two cold-rolling steps are performed, the cold-rolling process is preferably performed using rollers on a multi-roller frame, and particularly preferably a four-high mill.

The inventive method basically enables superplastically formable strips or superplastically formable foils of TiAl6V4 to be fabricated with a thickness of no more than 0.9 mm. The inventive method is in particular suitable for the fabrication of superplastically formable strips or superplastically formable foils of TiAl6V4 with a (final) thickness less than 0.7 mm, preferably less than or equal to 0.5 mm, particularly preferably less than or equal to 0.4 mm, more preferably between 0.1 mm and 0.3 mm, and most preferably of approximately 0.2 mm.

Another object of the present invention is a superplastically formable strip or a superplastically formable foil, respectively, of TiAl6V4 with a thickness of no more than 0.9 mm which is available by way of the above described inventive method.

The inventive strip or foil, respectively, distinguishes itself by an excellent superplastic formability. The inventive strip or foil, respectively, further shows a homogeneous microstructure, a uniform thickness and a smooth surface without pores. Moreover, the concentration of α-phases at the surface of the inventive strips or foils, respectively, made of TiAl6V4 is lower than in the conventional prior-art TiAl6V materials. According thereto, the surface of the inventive strips or foils, respectively, made of TiAl6V4 shows no α-case at all or an α-case with a thickness of only 1 to 2 μm, respectively, when examined by way of light-optical microscopy.

According to a preferred embodiment of the present invention, the inventive strip or the inventive foil respectively, has the following composition:

5.5 to 6.5 wt % of aluminum;
3.5 to 4.3 wt % of vanadium;
less than 0.02 wt % of nitrogen;
less than 0.05 wt % of carbon;
less than 0.15 wt % of oxygen;
less than 0.01 wt % of hydrogen;
less than 0.2 wt % of iron and
remainder: unavoidable impurities and titanium.

Particularly preferably, the inventive strip or the inventive foil, respectively, has the following composition:

5.5 to less than 6.0 wt % of aluminum;
3.5 to 4.2 wt % of vanadium;
less than 0.02 wt % of nitrogen;
less than 0.05 wt % of carbon;
less than 0.15 wt % of oxygen;
less than 0.01 wt % of hydrogen;
less than 0.15 wt % of iron and
remainder: unavoidable impurities and titanium.

As a development of the inventive idea, it is proposed that the thickness of the strip or the foil, respectively, is less than 0.7 mm, preferably less than or equal to 0.5 mm, particularly preferably less than 0.4 mm, more preferably between 0.1 and 0.3 mm and most preferably approximately 0.2 mm.

The following is a more detailed description of the present invention by way of two exemplary, non-liming examples.

EXAMPLE 1

The primary material used in this example was a hot-rolled TiAl6V4 sheet metal with a thickness of 1 mm, the sheet metal having the following composition (after hot-rolling):

Al: 5.6%; V: 4.2%; N: <0.02%; C: <0.05%; O: <0.15%; H: <0.01%; Fe: 0.1%.

The sheet metal was cut into strips with a width of 120 mm. The surface of these strips was slightly ground and cleaned. Afterwards, the strips were subject to high-vacuum annealing for 1 hour at 760° C. Cooling to ambient temperature was performed for 18 hours in high vacuum. The strips were cold-rolled on a four-high mill in single passes from approximately 10% at the beginning to approximately 2% at the end until an intermediate thickness of 0.4 mm was reached. At this intermediate thickness, the material was trimmed to 100 mm by means of a rotary blade cutter. Afterwards, the pre-rolled material was cold-rolled in single passes from approximately 5% at the beginning to approximately 1.5% at the end until an intermediate thickness of 0.25 mm was reached. The rolled strip was degreased and trimmed to 90 mm by means of a rotary blade cutter. Afterwards, the material was subject to intermediate annealing for 1 hour at 760° C. in high vacuum. Cooling to ambient temperature was performed for 18 hours in high vacuum. The intermediately annealed strip was then rolled in single passes of approximately 3% at the beginning to approximately 0.5% at the end by way of suitable smoothing passes until the final thickness of 0.2 mm was reached.

In order to prevent cracks from forming in the strips, it is conceivable to perform another intermediate trimming process in the intermediate rolling process, i.e. when the thickness is reduced from 1 to 0.4 mm.

After degreasing, the as-rolled strip fabricated in this manner was ready for superplastic formation in a relatively wide forming range.

EXAMPLE 2

The primary material used in this example was a hot-rolled TiAl6V4 sheet metal with a thickness of 1 mm, the sheet metal having the following composition (after hot-rolling):

Al: 5.6%; V: 4.2%; N: <0.02%; C: <0.05%; O: <0.15%; H: <0.01%; Fe: 0.1%.

The sheet metal was cut into strips with a width of 120 mm. The surface of these strips was slightly ground and cleaned. Afterwards, the strips were subject to high-vacuum annealing for 1 hour at 760° C., and were afterwards cooled down to ambient temperature for 12 hours in a high vacuum. The strips were cold-rolled in single passes on a four-high mill from approximately 10% at the beginning to approximately 2.5% at the end by way of corresponding smoothing passes until the final thickness of 0.5 mm was reached. The strip was degreased. The as-rolled strip material was then ready for superplastic formation in an adapted forming range.

What is claimed is:

1. A method of fabricating a material comprising a superplastically formable strip or a superplastically formable foil from TiAl6V4 with a thickness of no more than 0.9 mm, the method comprising the steps:

a) hot rolling a sheet metal made of TiAl6V4;
b) thermal pre-treating the hot-rolled sheet metal at a temperature between 650 and 850° C.; and
c) cold rolling the hot-rolled and thermally pre-treated sheet metal at a forming rate of at least 30%, wherein the forming rate per single pass amounts to between 1 and 15%, to form a material of the group consisting of a cold rolled strip and a cold rolled foil with a thickness of no more than 0.9 mm, wherein the respective material from the group consisting of the cold-rolled strip and the cold-rolled foil is not annealed in a finishing step.

2. A method according to claim 1, wherein the hot-rolling according to claim a) is performed at a temperature between 800° C. and 1,050° C.

3. A method according to claim 1, wherein the hot-rolling is performed at a forming rate of between 20 and 90%.

4. A method according to claim 1, wherein the TiAl6V4 alloy has the following composition after the hot-rolling according to step a):

5.5 to 6.5 wt % of aluminum;
3.5 to 4.3 wt % of vanadium;
less than 0.02 wt % of nitrogen;
less than 0.05 wt % of carbon;
less than 0.15 wt % of oxygen;
less than 0.01 wt % of hydrogen;
less than 0.2 wt % of iron; and
remainder: unavoidable impurities and titanium.

5. A method according to claim 1, wherein the thermal pre-treatment according to step b) is performed at a temperature between 700 and 800° C.

6. A method according to claim 5, wherein the thermal pre-treatment according to step b) is performed in high vacuum of no more than 13.3 mPa.

7. A method according to claim 1, wherein prior to the thermal pre-treatment according to step b) and prior to the cold-rolling according to step c), a mechanical pre-treatment of the hot-rolled sheet metal is performed.

8. A method according to claim 7, wherein the mechanical pre-treatment comprises at least one of grinding of the surface of the hot-rolled sheet metal, chemical cleaning and degreasing using a degreasing agent.

9. A method according to claim 1, wherein a mechanical pre-treatment of the hot-rolled sheet metal is performed simultaneously with the thermal pre-treatment according to step b) and prior to the cold-rolling according to step c).

10. A method according to claim 1, wherein a mechanical pre-treatment of the hot-rolled sheet metal is performed after the thermal pre-treatment according to step b) and prior to the cold-rolling according to step c).

11. A method according to claim 1, wherein the hot-rolled sheet metal used in step c) has a thickness of at least 1 mm.

12. A method according to claim 1, wherein the cold-rolling according to step c) is performed at a forming rate of between 30% and 80%.

13. A method according to claim 1, wherein the cold-rolling according to step c) is performed at a forming rate per single pass of between 2 and 10%.

14. A method according to claim 1, wherein the cold-rolling according to step c) comprises the following steps:

$c_1$) cold-rolling the hot-rolled and thermally pre-treated sheet metal of step b) at a forming rate of at least 30%, wherein the forming rate per single pass amounts to between 1 and 15%, to form a material of the group consisting of a strip and a foil with a thickness of no more than 0.9 mm;

$c_2$) intermediate annealing of a material of the group consisting of the strip and the foil obtained in step $c_1$) at a temperature between 650 and 850° C.; and $c_3$) cold-rolling of a material of the group consisting of the strip and the foil obtained in step $c_2$) at a forming rate of between 10 and 40% until the final thickness is achieved, wherein the forming rate per single pass amounts to between 0.1 and 10%.

15. A method according to claim 14, wherein the final thickness of a material of the group consisting of the strip and the foil after one of the steps comprising the cold-rolling step c) and the cold-rolling step $c_3$) is less than 0.7 mm.

16. A method according to claim 15, wherein the final thickness of a material of the group consisting of the strip and the foil after one of the steps comprising the cold-rolling step c) and the cold-rolling step $c_3$) is between 0.1 and 0.3 mm.

17. A method comprising the steps of:

providing a sheet metal comprising TiAl6V4;

hot rolling said sheet metal to form a hot-rolled sheet metal;

thermally pre-treating said hot-rolled sheet metal at a temperature between 650° C. and 850° C. to form a hot-rolled and thermally pre-treated sheet metal; and cold rolling said hot-rolled and thermally pre-treated sheet metal at a forming rate of at least 30%, wherein the forming rate per single pass amounts to between 1 and 15%, to form a material comprising a strip and a foil with a thickness of no more than 0.9 mm, wherein said material is not annealed after said step of hot rolling, said thermally pre-treating step and said cold rolling step.

18. A method comprising the steps of:

providing a sheet metal comprising TiAl6V4;

hot rolling said sheet metal;

thermally pre-treating said sheet metal at a temperature between 650° C. and 850° C. after hot rolling said sheet metal; and cold rolling said sheet metal at a forming rate of at least 30% after hot rolling and thermally pre-treating said sheet metal, wherein the forming rate per single pass amounts to between 1 and 15%, to form a material comprising a strip and a foil with a thickness of no more than 0.9 mm.

* * * * *